US005721094A

United States Patent [19]

Komatsu et al.

[11] Patent Number: 5,721,094

[45] Date of Patent: Feb. 24, 1998

[54] METHOD FOR PROCESSING SILVER HALIDE PHOTOGRAPHIC LIGHT-SENSITIVE MATERIAL

[75] Inventors: Hideki Komatsu; Shoji Nishio, both of Hino, Japan

[73] Assignee: Konica Corporation, Tokyo, Japan

[21] Appl. No.: 696,521

[22] Filed: Aug. 14, 1996

[30] Foreign Application Priority Data

Aug. 22, 1995 [JP] Japan ..... 7-213539

[51] Int. Cl.[6] ..... G03C 5/31

[52] U.S. Cl. ..... 430/440; 430/264; 430/398; 430/428; 430/429; 430/446; 430/480; 430/483; 430/463

[58] Field of Search ..... 430/264, 440, 430/446, 480, 483, 428, 429, 463, 398

[56] References Cited

U.S. PATENT DOCUMENTS

| | | | |
|---|---|---|---|
| 5,236,816 | 8/1993 | Purol et al. | 430/492 |
| 5,264,323 | 11/1993 | Purol et al. | 430/264 |
| 5,352,563 | 10/1994 | Kawasaki et al. | 430/264 |
| 5,503,965 | 4/1996 | Okutsu et al. | 430/399 |
| 5,506,092 | 4/1996 | Ishikawa et al. | 430/399 |
| 5,578,433 | 11/1996 | Morishima et al. | 430/436 |

FOREIGN PATENT DOCUMENTS

| | | |
|---|---|---|
| 0 704 756 A | 4/1996 | European Pat. Off. . |
| 0 710 880 A1 | 5/1996 | European Pat. Off. . |

OTHER PUBLICATIONS

Patent Abstracts of Japan, vol. 12, No. 166 (1988) of JP 62 279331A.

*Primary Examiner*—Hoa Van Le

*Attorney, Agent, or Firm*—Frishauf, Holtz, Goodman, Langer & Chick, P.C.

[57] ABSTRACT

A method of processing an exposed silver halide photographic light sensitive material is disclosed which comprises the steps of:

developing the exposed material with developer, the developer being replenished with developer replenisher and the developer containing no dihydroxy benzene and containing a developing agent represented by the following Formula [1]:

Formula [1]

wherein $R_1$ and $R_2$ independently represent an alkyl group, an amino group, an alkoxy group or an alkylthio group, or $R_1$ and $R_2$ combine with each other to form a ring, k represents 0 or 1, and X represents —CO— or —CS—;

fixing the developed material;

stabilizing the fixed material with a washing water which is replenished with water replenisher in a replenishing amount of 0.5 to 2 liter/$m^2$ or with a rinsing solution which is replenished with a rinsing replenisher in a replenishing amount of 0 to 2 liter/$m^2$; and drying the stabilized material.

11 Claims, No Drawings

METHOD FOR PROCESSING SILVER HALIDE PHOTOGRAPHIC LIGHT-SENSITIVE MATERIAL

FIELD OF THE INVENTION

The present invention relates to a method of processing a silver halide photographic light sensitive material, and especially to a method of processing a silver halide photographic light sensitive material which reduces a waste washing water without producing fur in the washing water.

BACKGROUND OF THE INVENTION

Recently , environmental problems are serious, and Research and development on products or systems which are friendly to environment has been made in various industrial fields. In graphic arts, there is a problem to be solved such as disposal of waste photographic processing solutions produced on replenishment of processing solutions when light sensitive materials are ordinarily processed using an automatic processor.

A washing water is replenished in a large amount, and the exhausted waste washing water is drained to sewerage, resulting in pollution of rivers, lakes, marshes or seas.

In some countries in Europe, waste water must be treated by waste solution disposers. Recently, reduction of photographic waste solutions, particularly waste washing water which is exhausted in a large amount, are eagerly desired.

The reason reduction of waste washing water or washing water replenishment is difficult is that residue is produced in a washing water tank of an automatic processor. The residue soils a silver halide photographic light sensitive material to be processed, the water tank, the transporting rollers or washing rollers. The residue causes also transport faults.

The addition of a cleaning agent, water regeneration due to electrolysis or washing water by counter current flow with multiple stage has been attempted, but the washing water amount is not reduced to the desired degree.

SUMMARY OF THE INVENTION

Accordingly, an object of the invention is to provide a method of processing a silver halide photographic light sensitive material, the method reducing an amount of a washing water without producing residue in the washing water.

DETAILED DESCRIPTION OF THE INVENTION

The above-mentioned object of the present invention has been attained by the following methods;

(1) A method for processing a silver halide photographic light sensitive material comprising a support and at least one silver halide emulsion layer on one side of the support with a developer, the developer containing substantially no dihydroxy benzene compound and containing a compound represented by the above Formula [1] and a replenishing amount of a washing water is 0.5 to 2 liter/$m^2$, or (2) The method for processing a silver halide photographic light sensitive material of (1) above, the method comprising a rinsing step using a rinsing solution instead of the washing water and a replenishing amount of the rinsing solution is 0 to 2 liter/$m^2$.

The present invention will be detailed below.

The developer used in the invention contains a compound represented by Formula [1] as a developing agent and contains substantially no dihydroxy benzene compound.

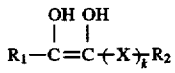

Formula [1]

in Formula [1], $R_1$ and $R_2$ independently represent a substituted or unsubstituted alkyl group, a substituted or unsubstituted amino group, a substituted or unsubstituted alkoxy group, a substituted or unsubstituted alkylthio group, or $R_1$ and $R_2$ combine with each other to form a ring; and k represents 0 or 1, provided that when k is 1, X represents —CO— or —CS—. The hydrogen atom of one of the —OH groups may be replaced with a sodium or potassium atom.

In Formula [1], Formula [1] can be an isomer represented by the following Formula [1'] (so-called tautomerizm):

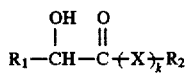

Formula [1']

The compound represented by the following Formula [1-a], in which $R_1$ and $R_2$ in the above mentioned Formula [1] combine with each other to form a ring, is preferable.

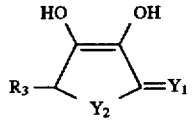

Formula [1-a]

wherein $R_3$ represents a hydrogen atom, a substituted or unsubstituted alkyl group, a substituted or unsubstituted aryl group, a substituted or unsubstituted amino group, a substituted or unsubstituted alkoxy group, a sulfo group, a carboxy group, an amido group or a sulfonamido group; $Y_1$ represents O or S; $Y_2$ represents O, S or $NR_4$ in which $R_4$ represents a hydrogen atom, a substituted or unsubstituted alkyl group or a substituted or unsubstituted aryl group.

In the above Formulas [1] and [1-a], the alkyl group represents preferably a lower alkyl group, for example, an alkyl group having 1 to 5 carbon atoms, the amino group represents preferably an unsubstituted amino group or an amino group having a lower alkyl group, the alkyl group represents preferably a lower alkoxy group, for example, an alkoxy group having 1 to 5 carbon atoms, the aryl group represents preferably a phenyl or naphthyl group, and each group may have a substituent and the substituent preferably includes a hydroxy group, a halogen atom, an alkoxy group, a sulfo group, a carboxyl group, an amido group or a sulfonamido group. One hydrogen atom of the —OH group in Formulas [1] and [1-a] may be replaced with a sodium or potassium atom.

The typical example of the compound in the invention represented by the above Formula [1] or [1-a] will be given below showing the example of each substituent, but the invention is not limited thereto.

Formula [1]

| Compound No. | X | | $R_1$ | $R_2$ |
|---|---|---|---|---|
| A-1 | — | (k = 0) | $HOCH_2CH(OH)—CH(OH)—$ | —OH |

-continued

Formula [1]

| Compound No. | X | $R_1$ | $R_2$ |
|---|---|---|---|
| A-2 | — (k = 0) | $CH_3CH(OH)-CH(OH)-$ | $-OH$ |
| A-3 | — (k = 0) | $HOCH_2CH(OH)-CH(OH)-$ | $-CH_3$ |
| A-4 | — (k = 0) | $CH_3CH(OH)-CH(OH)-$ | $-CH_3$ |
| A-5 | $-C(=O)-$ (k = 1) | $HOCH_2CH(OH)-CH(OH)-$ | $-OH$ |
| A-6 | $-C(=O)-$ (k = 1) | $CH_3CH(OH)-CH(OH)-$ | $-OH$ |
| A-7 | $-C(=S)-$ (k = 1) | $HOCH_2CH(OH)-CH(OH)-$ | $-OH$ |
| A-8 | $-C(=S)-$ (k = 1) | $CH_3CH(OH)-CH(OH)-$ | $-OH$ |
| A-9 | $-C(=O)-$ (k = 1) | $HO-CH_2-$ | $-OH$ |
| A-10 | $-C(=O)-$ (k = 1) | $HO-CH_2-$ | $-CH_2$ |
| A-11 | $-C(=O)-$ (k = 1) | $HO-CH_2-$ | $-C_2H_5$ |
| A-12 | $-C(=O)-$ (k = 1) | $HO-CH_2-$ | $-C_2H_4OH$ |

Formula [1-a]

| Compound No. | $Y_1$ | $Y_2$ | $R_3$ |
|---|---|---|---|
| A-13 | O | O | H |
| A-14 | O | O | $CH_3$ |
| A-15 | O | O | $CH_2(OH)$ |
| A-16 | O | O | $CH_3CH(OH)-$ |
| A-17 | O | O | $HOCH_2CH(OH)-$ |
| A-18 | O | O | $ClCH_2CH(OH)-$ |
| A-19 | O | O | $HOOCCH_2CH(OH)-$ |
| A-20 | S | O | H |

-continued

Formula [1-a]

| Compound No. | $Y_1$ | $Y_2$ | $R_3$ |
|---|---|---|---|
| A-21 | S | O | $CH_3CH(OH)-$ |
| A-22 | S | O | $HOCH_2CH(OH)-$ |
| A-23 | O | $NCH_3$ | H |
| A-24 | O | NH | $HOCH_2CH(OH)-$ |
| A-25 | O | S | H |
| A-26 | O | S | $HOCH_2CH(OH)-$ |
| A-27 | O | S | $CH_3CH(OH)-$ |
| A-28 | S | S | H |
| A-29 | S | S | $HOCH_2CH(OH)-$ |
| A-30 | S | S | H |

These compounds are typically ascorbic acid or erythorbic acid (isoascorbic acid) or derivatives thereof. They are available on the market and can be easily synthesized according to the well known synthesis method.

The content of the compound represented by Formula [1] is 0.2 to 0.4 mol/liter, and preferably 0.15 to 0.25 mol/liter of developer, and preferably 0.5 to 5 g/liter of developer.

The auxiliary developing agent showing superadditivity used in the developer together with the compound represented by Formula [1] includes 3-pyrazolidone derivatives or p-aminophenol derivatives. These compounds are well known for auxiliary developing agents. The typical compounds of the auxiliary developing agents will be shown below, but the invention is not limited thereto.

1-phenyl-3-pyrazolidone
1-phenyl-4,4'-dimethyl-3-pyrazolidone
1-phenyl-4-methyl-4-hydroxymethyl-3-pyrazolidone
1-phenyl-5-methyl-3-pyrazolidone
1-p-aminophenyl-4,4'-dimethyl-3-pyrazolidone
1-p-tolyl-4,4'-dimethyl-3-pyrazolidone
1-p-tolyl-4-methyl-4-hydroxymethyl-3-pyrazolidone
N -methyl-p-aminophenol
N-(β-hydroxyethyl)-p-aminophenol
N-(4-hydroxyphenyl)glycine
2-methyl-p-aminophenol
p-benzyl-p-aminophenol The invention is characterized in that the dihydroxy benzene compound is not substantially contained in the processing solution or in the developer used in the invention. The dihydroxy benzene compound herein referred to means a compound represented by the following Formula V-I, V-II or V-III, and it is a compound causing an allergic disease.

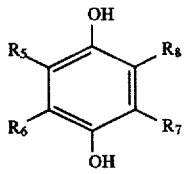

Formula V-I

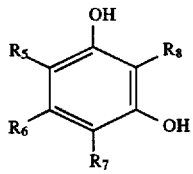

Formula V-II

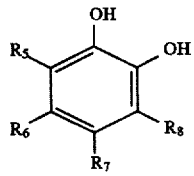

Formula V-III wherein $R_5$, $R_6$, $R_7$ and $R_8$ independently represent a hydrogen atom, an alkyl group, an aryl group, a carboxy group, a halogen atom or a sulfo group.

The typical compounds include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone or 2,5-dimethylhydroquinone. The most generally used compound is hydroquinone.

The developer used in the invention does not substantially contain dihydroxy benzenes. The term "not substantially contain" herein referred to means "contain no dihydroxy benzenes or contain dihydroxy benzenes in a such amount that the developing effect or allergy is realized." In the invention it is preferable that the developer contains no dihydroxy benzenes As silver sludge preventing agents, compounds as described in Japanese Patent Publication No. 62-4702/1987 and Japanese Patent O.P.I. Publication Nos. 1-319031/1989, 3-51844/1991, 4-26838/1992 and 4-362942/1992 can be used.

The developer waste can be regenerated by applying electric current. A waste developer tank in which a cathode (for example, a conductor or semiconductor such as stainless wool) is provided and an electrolyte tank in which an anode (for example, a conductor such as carbon, gold, platinum or titanium) is provided are arranged in such a manner that the waste developer is in contact with the electrolyte solution through an anion exchange membrane. The waste developer is regenerated by applying electric current to both electrodes. The light sensitive material can be processed while applying electric current. On generating developer, to the developer are added various additives such as preservatives, alkali agents, pH buffering agents, sensitizing agents, anti-foggants or anti-silver sludge agents. The light sensitive materials can be processed while applying current to the developer, to which the above additives can be further added.

The sulfites or metabisulfites as preservatives include sodium sulfite, potassium sulfite, ammonium sulfite and sodium metabisulfite. The amount used of the sulfite is not less thorn 0.25 mol per liter, and preferably not less than 0.4 mol per liter of developer.

Besides the above compounds the developer optionally contains alkali agents (sodium hydroxide or potassium hydroxide), pH buffering agents (for example, carbonates, phosphates, borates, boric acid, acetic acid, citric acid or alkanol amines), auxiliary solubility agents (for example, polyethylene glycols or esters thereof or alkanol amines), sensitizing agents (for example, non-ionic surfactants including polyoxy ethylenes or quaternary ammonium salts), surfactants, anti-foggants (for example, halides such as potassium bromide and sodium bromide, nitro benzindazole, nitro benzimidazole, benzotriazoles, benzothiazoles, tetrazoles or thiazoles), chelating agents (for example, ethylenediaminetetraacetic acid or an alkali metal salt thereof, nitrilotriacetic acid salts or polyphosphoric acid salts), development accelerators (for example, compounds described in U.S. Pat. No. 2,394,025 and Japanese Patent Publication No. 47-45541), hardeners (for example, glutaraldehyde or a bisulfite adduct thereof) or anti-foaming agents. The pH of the developer is preferably adjusted to be 8.5 to 10.5, when the total processing time (dry to dry processing time) is 60 seconds or less.

As a particular case in which the developing agent is contained in the light sensitive material, for example, in the emulsion layer, the light sensitive material is developed with an alkali solution, which is an activator processing solution. Such a development is often used as one of rapid processes in combination with silver stabilizing treatment of a thiocyanate, and the compounds of the invention can be applied thereto. In such a rapid process, the invention exhibits especially desirable effects.

A fixer having a conventional composition can be used. The fixer is usually an aqueous solution comprised of a fixing agent and other additives, and has a pH of 3.8 to 5.8. As the fixing agent, thiosulfates such as sodium thiosulfate, potassium thiosulfate or ammonium thiosulfate, thiocyanates such as sodium thiocyanate, potassium thiocyanate or ammonium thiocyanate, or organic sulfur compounds capable of producing soluble stable silver complexes can be used.

To the fixer can be added water soluble aluminum salts acting as a hardener such as aluminum chloride, aluminium sulfate and potash alum. To the fixer can be optionally added preservatives such as sulfites or metabisulfites, pH buffering agents (for example, acetic acid), pH regulators (for example, sulfuric acid) or chelating agents capable of softening hard water.

The developer used for the silver halide photographic light sensitive material in the invention may be a mixture of solid components, an organic solution containing glycol or amines or a viscous pasty liquid having a high viscosity. The development temperature in the invention may be within a conventional range of 20° to 30° C., or within a higher range of 30° to 40° C.

The silver halide photographic light-sensitive material in the invention is preferably processed using an automatic developing apparatus. On development the material is processed while replenishing a specific amount of developer replenisher in proportion to the area of the material processed. Developer replenishing amount is not more than 300 ml per $m^2$, preferably 75 to 200 ml per $m^2$ of the material processed, in view of reducing waste solution.

In the invention, when using an automatic developing apparatus, the total processing time (Dry to Dry processing time) is preferably 10–60 seconds. The total processing time is the time taken from the entry of the leading edge of a film in the apparatus to the delivery of the tail end of the film out of the drying zone of the apparatus. The total processing time referred to herein is the total time necessary to process black-and-white silver halide photographic light-sensitive material, and concretely, the time necessary to carry out the steps, developing, fixing, bleaching, washing or stabilizing and drying, which is Dry to Dry time. Dry to Dry processing time less than 10 seconds results in desensitizing and low contrast, and does not exhibit satisfactory results. Dry to Dry processing time is more preferably 15 to 50 seconds.

The automatic processor comprises a drying zone in which heat conductors of 90° C. or more (for example, a heat roller of 90° C. to 130° C.) or heat radiation materials of 150° C. or more (for example, a material such as tungsten, carbon, nichrome, zirconium oxide.yttrium oxide.thorium mixture or silicon carbide emitting an infrared light by applying electric current or a heat radiating material such as copper, stainless steel, nickel, or ceramics heated by receiving heat from a heating element) are provided.

The processing of a silver halide photographic light sensitive material in the invention is characterized in that a washing water replenishing amount is reduced or an image stabilization is carried out using a rinsing solution instead of a washing water. The washing step is a step after development and fixing, which washes off unnecessary matters produced on the silver halide photographic light sensitive material during the previous steps. The washing water replenishing amount in the invention is 0.5 to 2 liter/$m^2$, and preferably 0.5 to 1 liter/$m^2$. In the processing without using a washing water, a rinsing solution is used for stabilization, and the rinsing solution replenishing amount is 0 to 2 liter/$m^2$.

Next, the rinsing solution will be explained.

In the latter half steps of the silver halide photographic light sensitive material processing steps, washing water washing step is carried out for stabilization, followed by drying. That is, the latter half steps are to wash off chemicals, which are remained on the silver halide photographic light sensitive material in the previous steps including a fixing step, whereby an image stability is enhanced.

Rinsing reduces an amount of washing water, which is used in a large amount, neutralizes or chelates chemicals remained on the silver halide photographic light sensitive material for stabilizing, or prevents occurrence of silver sulfide for stabilizing, which is produced by oxidation of soluble silver complexes from a fixer. Therefore, the rinsing is also called stabilizing.

Conventional washing or rinsing methods known in the art are applicable to the washing or rinsing treatment regarding the invention. A solution containing conventional additives can be used as a rinsing solution. A rinsing solution or water subjected to anti-fungal treatments can be also used.

The rinsing solution contains a chelating agent in order to prevent silver sulfides which produces by oxidation of a soluble silver complex which remains on a light sensitive material due to washing water reduction. The chelating compound includes EDTA, NTA, DTPA or its alkali metal salt. The rinsing solution contains a chelating agent in an amount of preferably 0.05 to 1 mol/liter, more preferably 0.05 to 0.2 mol/liter.

Means for anti-fungal treatments include an ultra-violet radiation method described in Japanese Patent O.P.I. Publication No. 60-263939/1985, a method using a magnetic field described in Japanese Patent O.P.I. Publication No. 60-263940/1985, a method for making pure water using an ion-exchange resin described in Japanese Patent O.P.I. Publication No. 61-131632/1986 and a method using fungicide described in Japanese Patent O.P.I. Publication No. 62-11515/1987, 62-153952/1987, 62-220951/1987 and 62-209532/1987.

Anti-molds, anti-fungals or surfactants can be used in combination which are disclosed in L. E. West, "Water Quality Criteria", Photo. Sci. & Eng., Vol. 19, No. 6 (1965), M. W. Beach, "Microbiological Growths in Motion-picture Processing", SMPTE Journal Vol. 35 (1976), R. O. Deegan, "Photo. Processing Wash Water Biocides", Journal Imaging Tech. Vol. 10, No. 6 (1984) and Japanese Patent O.P.I. Publication Nos. 57-3542/1982, 57-58143/1982, 58-105145/1983, 57-132146/1982, 58-18631/1983, 57-97530/1982 and 57-157244/1982.

The stabilizing solution used in the invention may contain, as anti-fungals, isothiazolines disclosed in R. T. Kreiman, Image Tecq., 10(6), 242 (1984), isothiazolines disclosed in Research and Disclosure (RD), 205, 20526 (1981, May) or compounds disclosed in Japanese Patent O.P.I. Publication No. 61-209532/1986.

The examples of the anti-molds include phenol, 4-chlorophenol, pentachlorophenol, cresol, o-phenylphenol, chlorophene, dichlorophene, o-chlorophenol, formaldehyde, glutaraldehyde, chloroacetamide, p-hydroxybenzoic acid ester, 2-(4-thiazoline)benzimidazol, benzisothiazoline-3-one, dodecyl-benzyl-dimethylammonium chloride, N-(fluorodichloromethylthio)-phthalimide, 2,4,4'-trichloro-2'-hydroxydiphenylether.

In order to prevent water drops on the light sensitive material, the washing water may contain various surfactants, in addition to a silver image stabilizing agent. The surfactants may be cationic, anionic, nonionic or amphoteric. The examples thereof are described in, for example, "Surfactant Handbook", issued by Kogakutosho Co., Ltd.

In order to stabilize an image, various compounds can be added to the rinsing solution used in the invention. The examples thereof include buffering agents for adjusting a layer pH such as borates, metaborates, borax, phosphates, carbonates, potassium hydroxide, sodium hydroxide, aqueous ammonia, monocarboxylic acids, dicarboxylic acids, polycarboxylic acids or a combination thereof and aldehydes such as formalin.

Besides the above, various additives such as chelating compounds, anti-fungals (thiazoles, isothiazoles, halogenated phenol, sulfanylamides or benzotriazoles), surfactants, brightening agents and hardeners can be added to the rinsing solution. These additives may be used singly or in combination.

As a layer pH adjusting agent, ammonium salts such as ammonium chloride, ammonium nitrate, ammonium sulfate, ammonium phosphate and ammonium thiosulfate may be added.

The silver halide of the silver halide emulsion is silver bromochloride or bromoiodochloride having a silver chloride content of 50 to 85 mol%. When the silver chloride content is outside the above range, image reproduction deteriorates.

The average grain size of the silver halide grains is preferably not more than 0.7 μm, and more preferably not more than 0.3 to 0.1 μm. The grain size herein referred to is a grain diameter when grains are spherical or approximately spherical. When cubic, the size is a diameter in terms of spheres. A method of measuring the average grain size is detailed in T. H. James, "The Theory of the Photographic Process", the third edition, p. 36–43, (1966, issued by Mcmillan Co. Ltd.).

The silver halide grain shape is not specifically limited, and may be tabular, spherical, cubic, tetradecahedral, octahedral and the like. The grain size distribution is preferably narrow, and the silver halide emulsion is preferably a monodisperse emulsion in which 90% or more preferably 95% or more of the grains fall within the range of ±40% of the average grain size.

As a method of reacting a soluble silver ion with a soluble halide in the manufacture of a silver halide emulsion, a normal precipitation method, a double jet precipitation method or a combination thereof can be used.

A method of forming grains in the presence of an excess silver ion, so-called a reverse precipitation method can be used. As one method of the double jet precipitation, a method of maintaining pAg of the silver halide forming solution constant, so-called a controlled double jet method can be used. According to this method, silver halide grains of regular shape having an approximately uniform grain size.

During silver grain formation or growth, at least one of salts or complexes of a transition metal such as cadmium, zinc, lead, thallium, ruthenium, osmium, iridium or rhodium are preferably added to the silver halide emulsion. The addition amount of these is $10^{-8}$ to $10^{-4}$ mol per mol of silver. The especially preferable transition metal is Rh or Re.

The silver halide emulsion and the preparing method thereof are detailed in Research and Disclosure (RD), 176, 17643, p. 22–23 (December, 1978) or in references cited in the same.

The silver halide emulsion is preferably chemically sensitized. The chemical sensitization method includes sulfur, reduction or noble metal sensitization, and this may be used singly or in combination. The preferable chemical sensitization is sulfur sensitization, and the sulfur sensitizer includes various sulfur compounds such thiosulfates, thiourea, rhodanines or polysulfides, in addition to a sulfur compound contained in gelatin.

The typical noble metal sensitization is gold sensitization. The complex of a noble metal other than gold, for example, platinum, palladium or rhodium can be used.

The reduction sensitizer includes stannous salts, amines, formamidines, sulfinic acids, silane compounds or ascorbic acid.

The silver halide emulsion can be spectrally sensitized by sensitizing dyes. The sensitizing dyes includes cyanine dyes, merocyanine dyes, complex cyanine dyes, complex merocyanine dyes, holopolar cyanine dyes, hemicyanine dyes, styryl dyes or hemioxonol dyes. The dyes may contain any nucleus ordinarily used in cyanine dyes as a basic heterocyclic ring. The ring includes a pyrroline, oxazoline, thiazoline, pyrrole, oxazole, thiazole, selenazole, imidazole, tetrazole or pyridine nucleus, or its ring condensed with an aliphatic or aromatic hydrocarbon ring including an indolenine, indol, benzoxazole, benzothiazole, naphthothiazole, benzoselenazole, benzimidazole or quinoline nucleus. These nucleus may have a substituent. The merocyanine dyes or complex merocyanine dyes include, as a nucleus containing keto-methylene, a 5- or 6-membered heterocyclic ring such as a pyrazoline-5-one, thiohydantoin, 2-thiooxazolidine-2,4-dione, thiazolidine-2,4-one or rhodanine, thiobarbituric acid nucleus. Typically, those disclosed in (RD) above, 176, 17643 (December, 1978), p. 23 and 24, (RD) 34686 (1993), U.S. Pat. Nos. 4,425,425 and 4,425,426 are employed. In the invention, sensitizing dyes having a relatively long wavelength light absorption are effected in photographic stability. The especially effective sensitizing dyes include those disclosed in Japanese Patent O.P.I. Publication Nos. 6-194771/1994, 6-194774/1994, 6-242533/1994, 5-119425/1993, 5-158181/1993 and 6-195578/1994.

The method of dissolving or dispersing dyes in a solvent and adding to an emulsion includes those disclosed in U.S. Pat. Nos. 3,482,981, 3,585,195, 3,469,987, 3,425,835 and 3,342,605, British Patent Nos. 1,271,329, 1,038,029 and 1,121,174 and U.S. Pat. Nos. 3,660,101 and 3,658,546. The dyes may be dissolved employing a ultrasonic vibration disclosed in U.S. Pat. No. 3,485,634.

Thes dyes may be used singly or in combination, and a combination thereof is often used for supersensitization. A dye combination or substances, which show supersenstization, are disclosed in (RD), 176, 17643 (December, 1978).

The silver halide photographic light sensitive material used in the invention may contain various compounds to prevent fog during the manufacture, storage or photographic processing or to stabilize photographic properties. The compounds include well known compounds as anti-foggants or stabilizing agents such as azoles (benzothiazoliums, nitroindazoles, nitrobenzimidazoles, chlorobenzimidazoles, bromobenzimidazoles, mercaptothiazoles, mercaptobenzothiazoles, mercaptothiadiazoles, aminotriazoles, benzotriazoles, nitrobenzotriazoles), mercaptotetrazoles (especially, 1-phenyl-5-mercaptotetrazoles), mercaptopyrimidines, mercaptotriazines, azaindenes (especially, 4-hydroxy-1,3,3a,7-tetraazaindenes), pentazaindenes, benzenethiosulfonic acid, benzenesulfinic acid or benzenesulfonamide.

The photographic emulsion or non-light sensitive hydrophilic colloid in the invention may contain inorganic or organic hardeners. The hardeners include chromium salts (chrome alum, chromium acetate), aldehydes (formaldehyde, glyoxal, glutaraldehyde), a N-methylol compound (dimethylolurea, methyloldimethylhydantoin), dioxane derivatives (2,3-dihydroxydioxane), active vinyl compounds (1,3,5-triacroyl-hexahydro-s-triazine, bis (vinylsulfonyl)methylether, active halogen compounds (2,4-dichloro-6-hydroxy-s-triazine), mucohalogen acids (mucochloric acid, phenoxymucochloric acid), isooxazoles, starch dialdehyde, 2-chloro-6-hydroxy-triazinylated gelatin or peptide hardeners disclosed in DE 2,225,230, and Japanese Patent O.P.I. Publication Nos. 1-198774/1990, 5-61139/1993 and 6-194168/1994. The hardeners may be used singly or in combination.

The photographic emulsion or non-light sensitive hydrophilic colloid in the invention may contain a coating auxiliary or various conventional surfactants to prevent static, improve sliding property, help emulsify, prevent adhesion, and improve photographic properties.

Gelatin is advantageously used as a binder or protective colloid of a photographic emulsion, but another hydrophilic colloid can be used. The examples of the hydrophilic colloid include gelatin derivatives, grafted gelatins with another polymer, proteins such as albumin or casein, cellulose derivatives such as hydroxycellulose, carboxymethylcellulose or cellulose sulfate, saccharides such as sodium alginate or starch derivatives and synthetic hydrophilic polymers such as polyvinyl alcohol, polyvinyl alcohol partial acetal, poly-N-vinyl pyrrolidone, polyacrylic acid, polymethacrylic acid, polyacryl amide, polyvinyl imidazole or polyvinyl pyrazole.

Gelatin includes limed gelatin, acid processed gelatin, gelatin hydrolysate or enzyme decomposed gelatin.

The photographic emulsion in the invention may contain water insoluble or sparingly soluble synthetic polymer in order to improve dimensional stability. The synthetic polymer includes polymers obtained by polymerization of alkyl (meth)acrylate, alkoxyacryl(meth)acrylate, glycidyl (meth) acrylate, (meth)acryl amide, vinylester such as vinyl acetate, acrylonitrile, olefin, styrene or a combination thereof, or its combination with acrylic acid, methacrylic acid, α,β-unsaturated dicarboxylic acid, hydroxyalkyl(meth)acrylate, sulfoalkyl(meth)acrylate or styrene sulfonic acid.

The light sensitive material used in the invention preferably contains a hydrazine derivative.

The hydrazine derivative is a compound represented by the following Formula [H]:

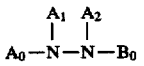

Formula [H]

In Formula [H], $A_0$ represents an aliphatic group, an aromatic group or a heterocyclic group. The aliphatic group represented by $A_0$ represents preferably a group having 1 to 30 carbon atoms, and more preferably a straight-chained, branched or cyclic alkyl group having 1 to 20 carbon atoms. The example includes a methyl, ethyl, t-butyl, octyl, cyclohexyl or benzyl group, each of which may have a substituent such as an aryl, alkoxy, aryloxy, alkylthio, arylthio, sulfoxy, sulfonamide, sulfamoyl, acylamino, or ureido group.

The heterocyclic group represented by $A_0$ represents preferably an aryl group with a single or condensed ring such as a benzene ring or a naphthalene ring.

The heterocyclic group represented by $A_0$ represents preferably a heterocyclic group with a single or condensed ring containing one hetero atom selected from a nitrogen, sulfur and oxygen atom, for example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring or a furan ring.

A especially preferably represents an aryl group or a heterocyclic group. The aryl or heterocyclic group of A has preferably a substituent. The examples of the substituent include an alkyl group, an aralkyl group, an alkinyl group, an alkoxy group, a substituted amino group, an acylamino group, a sulfonylamino group, a ureido group, a urethane group, an aryloxy group, a sulfamoyl group, a carbamoyl group, an alkylthio group, an arylthio group, a sulfothio group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamide group, a sulfonamide group, a carboxy group or a phosphonamide group. These substituents may further have a substituent.

When a light sensitive material is processed employing a developer having a pH of not more than 10.5 in a total processing time (Dry to Dry processing time) of 60 seconds or less, a compound having an acidic group giving a $pK_a$ of 7 to 11 such a sulfonamide group, a hydroxy group or a mercapto group is preferably used. The especially preferable is a compound having a sulfonamide group.

$A_0$ preferably has at least one of a non-diffusible group and a silver halide adsorption group. The non-diffusible group is preferably a ballast group which is conventionally used in immobile photographic additives such as couplers, and the ballast group includes an alkyl, alkenyl, alkinyl or alkoxy group having not less than 8 carbon atoms or a phenyl, phenoxy or alkylphenoxy group, which is relatively inactive to photographic properties.

The silver halide adsorption group includes a thiourea, thiourethane, mercapto, thioether, thion, heterocyclic, thioamidoheterocyclic or mercaptoheterocyclic group or an adsorption group described in Japanese Patent O.P.I. Publication No. 64-90439/1989.

$B_0$ represents a blocking group, and preferably represents —$G_0$—$D_0$, wherein $G_0$ represents —CO—, —COCO—, —CS—, —C (=$NG_1D_1$)—, —SO—, —$SO_2$— or —P(O)($G_1D_1$)— in which $G_1$ represents a single bond, —O—, —S— or —N($D_1$)—, in which $D_1$ represents a hydrogen atom, an aliphatic group, an aromatic group or a heterocyclic group, provided that when plural $D_1$s are present in the molecule, $D_1$ may be the same or different.

$D_0$ represents a hydrogen atom, an aliphatic group, an aromatic group, a heterocyclic group, an amino group, an alkoxy group, an aryloxy group, an alkylthio group or an arylthio group.

$G_0$ preferably represents —CO— or —COCO—, and especially preferably —COCO—. $D_0$ preferably represents a hydrogen atom, an alkoxy group or an amino group.

$A_1$ and $A_2$ represent both hydrogen atoms or one of $A_1$ and $A_2$ represents a hydrogen atom and the other represents an acyl group (acetyl, trifluoroacetyl, benzoyl), a sulfonyl group (methanesulfonyl, toluenesulfonyl) or an oxalyl group (ethoxalyl).

The Exemplified compounds represented by Formula [H] will be shown below, but the invention is not limited thereto.

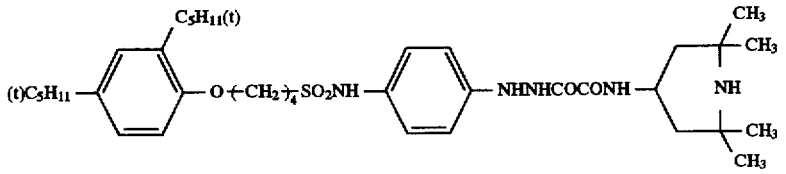

H-1

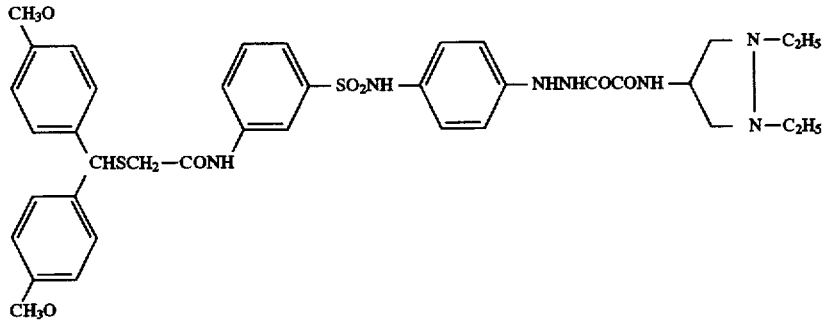

H-2

-continued
H-3
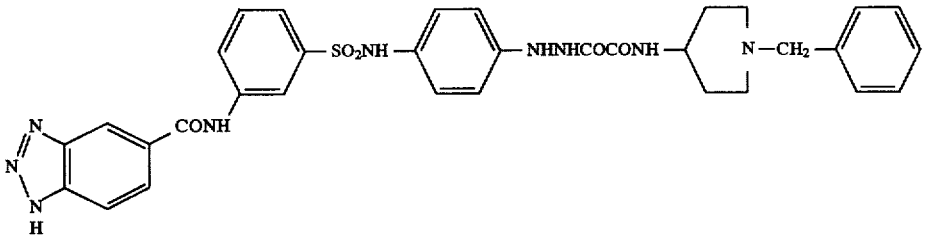
H-4
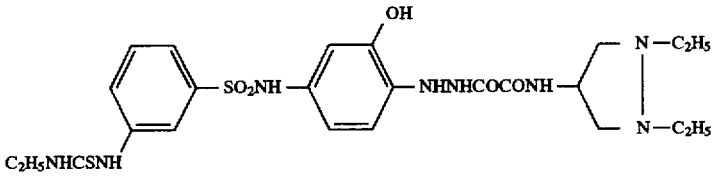
H-5
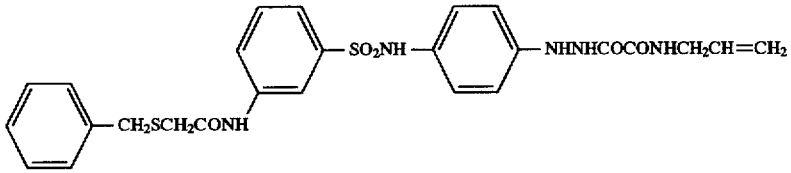
H-6
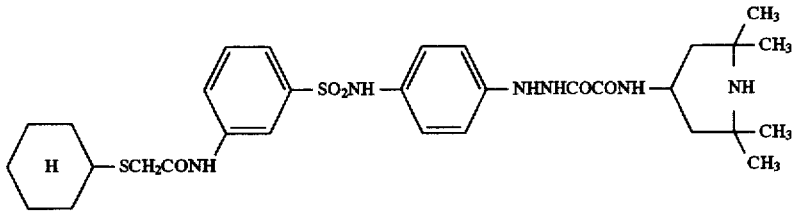
H-7
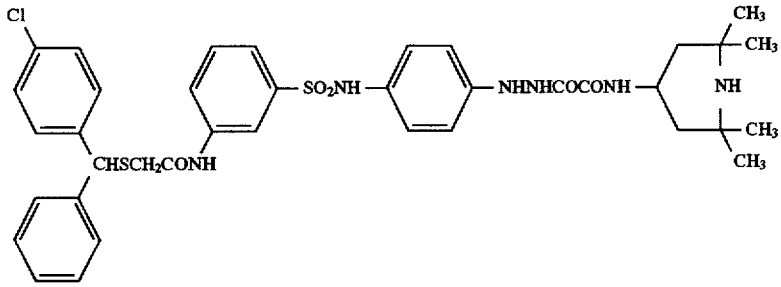
H-8
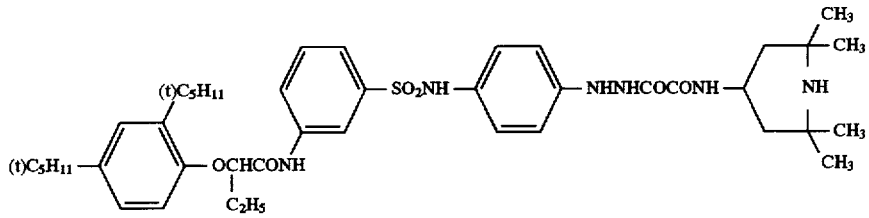
H-9
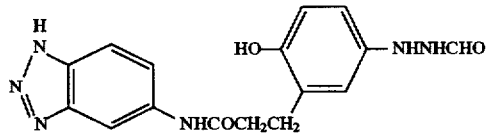
H-10
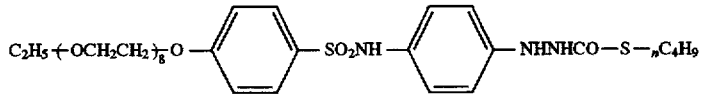

-continued
H-11
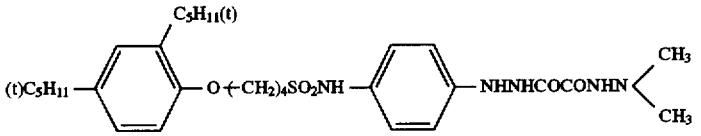
H-12
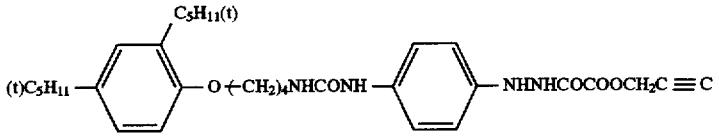
H-13
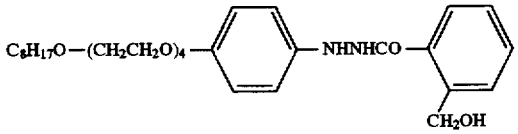
H-14
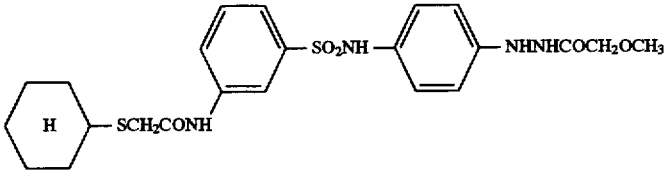
H-15
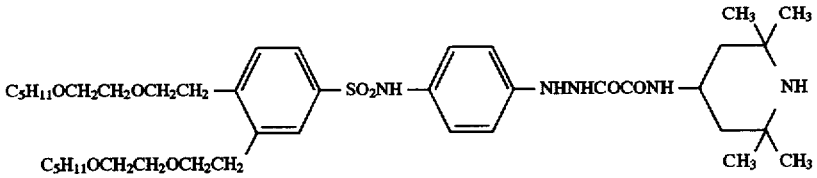
H-16
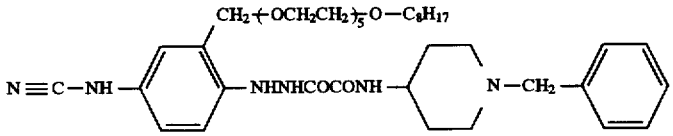
H-17
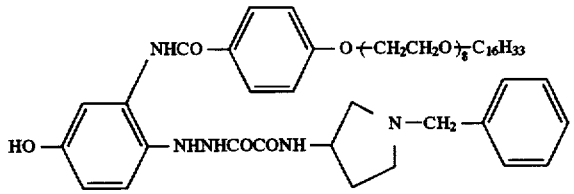
H-18
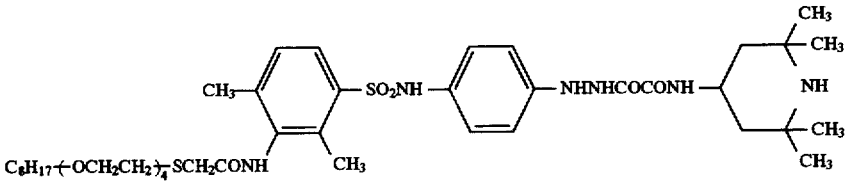
H-19
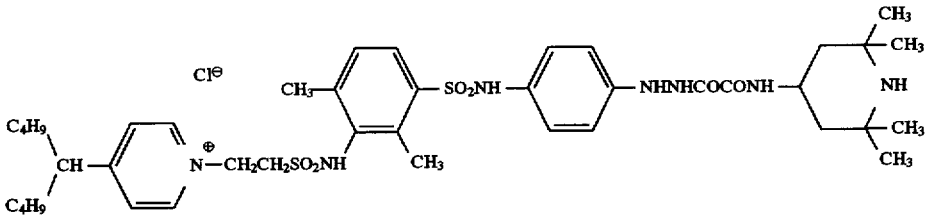

-continued

H-20

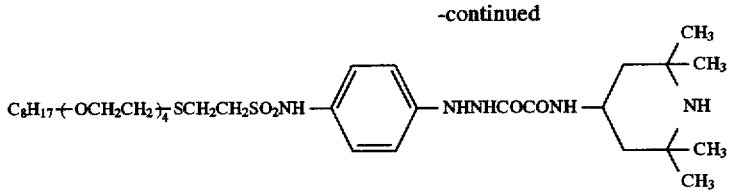

H-21

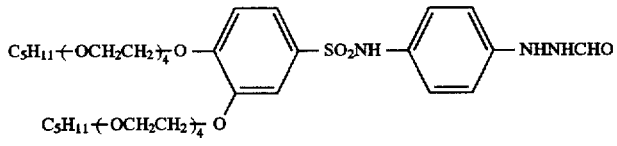

H-22

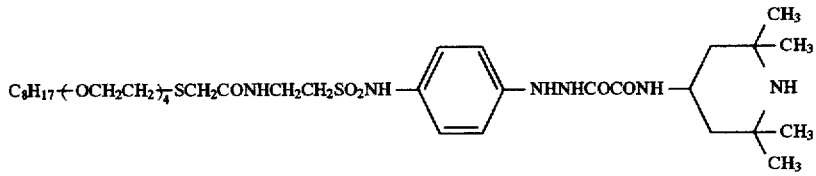

H-23

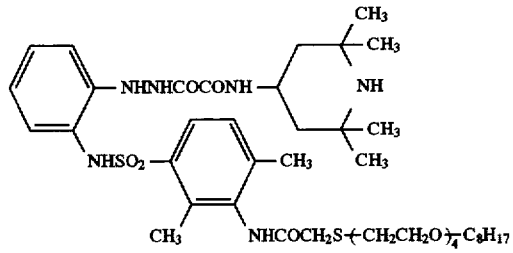

H-24

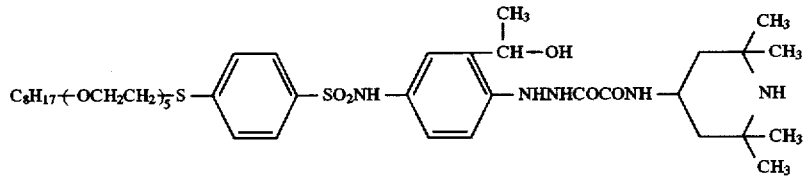

H-25

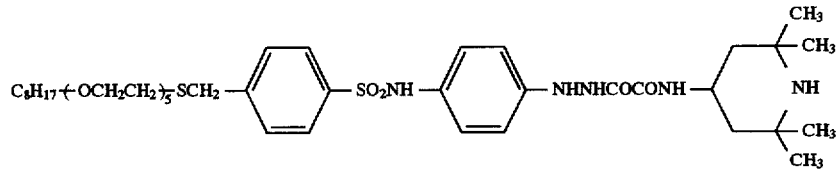

In the invention, when a hydrazine derivative is used, a nucleation accelerating agent represented by the following Formula [Na] or [Nb] is preferably used in order to effectively promote contrast increase.

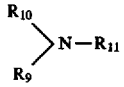

Formula [Na]

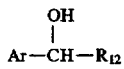

Formula [Nb]

In Formula [Na], $R_9$, $R_{10}$ and $R_{11}$ independently represent a hydrogen atom, an alkyl group, a substituted alkyl group, an alkenyl group, a substituted alkenyl group, an alkinyl group, an aryl group or a substituted aryl group, provided that $R_9$, $R_{10}$ and $R_{11}$ are not simultaneously hydrogen atoms, or $R_9$, $R_{10}$ and $R_{11}$ form a ring together.

The preferable of Formula [Na] is represented by the following Formula [Na-2].

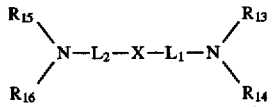

In Formula [Na-2], $R_{13}$, $R_{14}$, $R_{15}$ and $R_{16}$ independently represent a hydrogen atom, an alkyl group, a substituted alkyl group, an alkenyl group, a substituted alkenyl group, an alkinyl group, a substituted alkinyl group, an aryl group, a substituted aryl group or a saturated or unsaturated heterocyclic group or $R_{13}$ and $R_{14}$, or $R_{15}$ and $R_{16}$ combine with each other to form a ring. $R_{13}$ and $R_{14}$ are not simultaneously hydrogen atoms. $R_{15}$ and $R_{16}$ are not simultaneously hydrogen atoms.

X represents an S, Se or Te atom.

$L_1$ and $L_2$ independently represent a divalent likage group. The example includes the linkage group shown below or its combination, each of which may have a substituent (for example, alkylene, alkenylene, arylene, acylamino or sulfonamide).

—$CH_2$—, —CH=CH—, —$C_2H_4$—, —N($Z_1$)— (in which $Z_1$ represents a hydrogen atom, an alkyl group or an aryl group), —O—, —S—, —(CO)—, —($SO_2$)—, —$CH_2$—. The linkage group preferably contains at least one of the following groups:

—[$CH_2$—$CH_2$O]—, —[C($CH_3$)H$CH_2$O]—, —[OC($CH_3$)H$CH_2$O]—, —[O$CH_2$C(OH)H$CH_2$]—.

The preferable agent is an aliphatic tertiary amines. These compounds preferably have in the molecule a non-diffusible group or a silver halide adsorption group. The compounds having non-diffusible property have preferably a molecular weight not less than 100, and more preferably a molecular weight not less than 300. The preferable adsorption group includes a heterocyclic, mercapto, thioether, thion or thiourea group.

The Exemplified compounds represented by Formula [Na] or [Na-2] will be shown below.

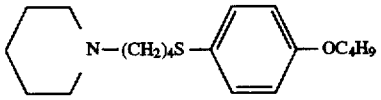

Na-1

$[(C_3H_7)_2N(CH_2)_3OCH_2CH_2]_2S$ Na-2

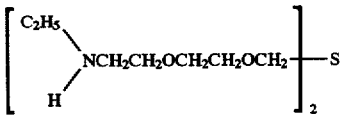

Na-3

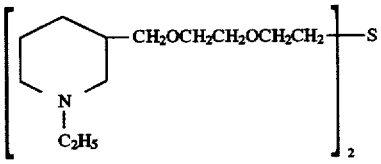

Na-4

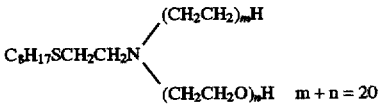

Na-5

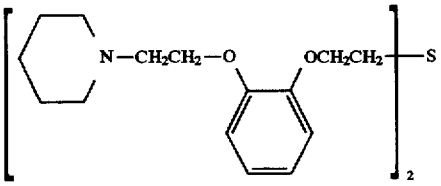

Na-6

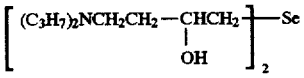

Na-7

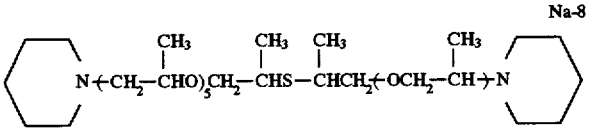

Na-8

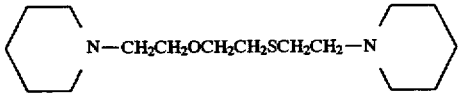

Na-9

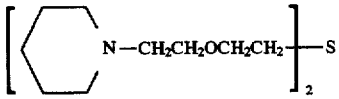

Na-10

-continued

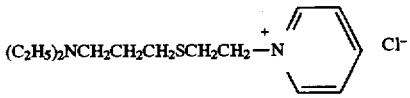

Na-11

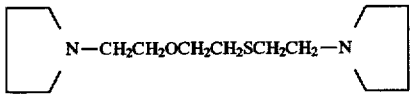

Na-12

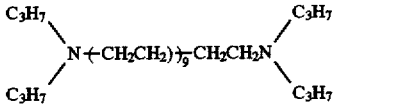

Na-13

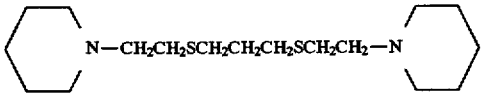

Na-14

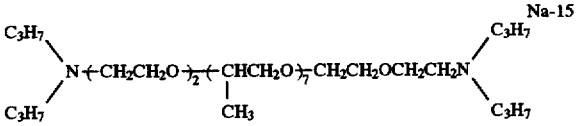

Na-15

$[(C_2H_5)_2N(CH_2)_3NHCOCH_2\frac{1}{2}$—Se Na-16

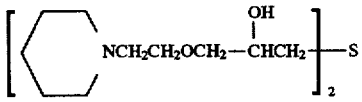

Na-17

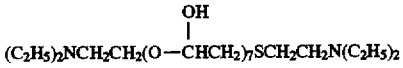

Na-18

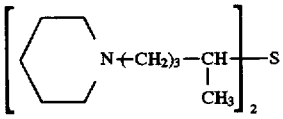

Na-19

In Formula [Nb], Ar represents a substituted or unsubstituted, aryl or heterocyclic group. $R_{12}$ represents a hydrogen atom, an alkyl group, an alkinyl group or an aryl group or Ar and $R_{12}$ combine through another linkage group to form a ring. These compounds preferably have in the molecule a non-diffusible group or a silver halide adsorption group. The compounds having non-diffusible property have preferably a molecular weight not less than 120, and more preferably a molecular weight not less than 300. The preferable adsorption group includes the same as those denoted in Formula [H].

The Exemplified compounds represented by Formula [Nb] will be shown below.

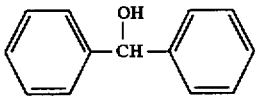

Nb-1

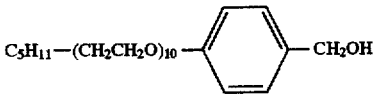

Nb-2

-continued

Nb-3

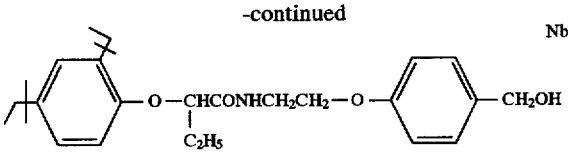

Nb-4

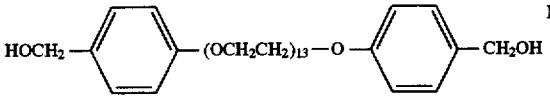

Nb-5

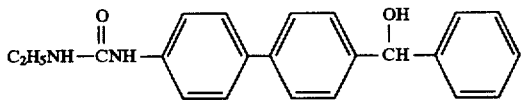

Nb-6

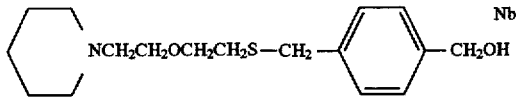

Nb-7

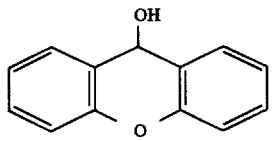

Nb-8

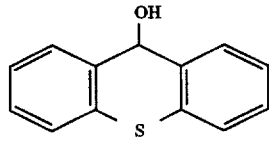

Nb-9

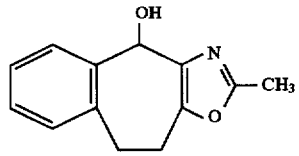

Nb-10

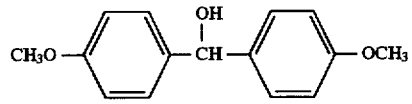

Nb-11

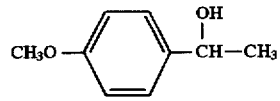

Nb-12

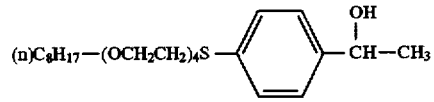

The silver halide photographic light sensitive material used in the invention may contain a tetrazolium compound. The tetrazolium compound is a compound represented by the following Formula [T]:

Formula [T]

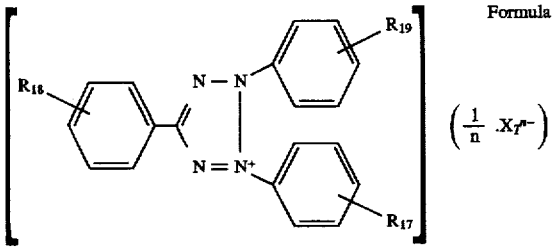

$R_{17}$, $R_{18}$ and $R_{19}$, which are substituents on the phenyl group of the phenyltetrazolium compound represented by Formula [T], independently represent preferably a hydrogen atom or a group having a negative value of a Hammett's sigma value representing electron attractivity.

The Hammett's value in the phenyl group is described in many literatures, for example, C. Hansch, Journal of Medical Chemistry, 20, p. 304 (1977). In Formula [T], the examples having a especially preferable negative sigma value include, for example, methyl (σP=−0.17, hereinafter represented by a sigma value), ethyl (−0.15), cyclopropyl (−0.21), n-propyl (−0.13), isopropyl (−0.15), cyclobutyl (−0.15), n-butyl (−0.16), isobutyl (−0.20), n-pentyl (−0.15), cyclohexyl (−0.22), amino (−0.66), acetylamino (−0.15), hydroxyl (−0.37), methoxy (−0.27), ethoxy (−0.24), propoxy (−0.55), butoxy (−0.32), and pentoxy (−0.34). These are useful for the substituents of the compound represented by Formula [T].

n represents 1 or 2, and the anion represented by $X_T^{n-}$ includes, for example, a halogen ion such as a chloride ion, a bromide ion or an iodide ion, an inorganic acid residue such as nitric acid, sulfuric acid or perchloric acid, an organic acid residue such as sulfonic acid or carboxylic acid, an anionic surface active agent typically including a lower alkyl benzene sulfonic acid anion such as a p-toluene sulfonic acid anion, a higher alkyl benzene sulfonic acid anion such as a p-dodecyl benzene sulfonic acid anion, a higher alkyl sulfate anion such as a lauryl sulfate anion, a borate anion such as a tetraphenyl borate, a dialkyl sulfosuccinate anion such as a di-2-ethylhexyl succinate anion, a higher aliphatic anion such as acetyl polyetenoxy sulfate anion, and a polymer with an acid residue such as a polyacrylic acid anion.

The typical examples of compounds represented by Formula [T] will be given below, but the compounds of the invention shall not be limited thereto.

| Compound No. | $R_{17}$ | $R_{18}$ | $R_{19}$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The above tetrazolium compounds can be easily synthesized according to a method as disclosed in Chemical Reviews, 55, p. 335–483.

The compounds represented by Formula [T] can be used singly or in combination.

The hydrazine derivative or (a pyridinium compound), the nuclear promoting agent or the tetrazolium compound used in the invention can be added to any layer on the silver halide emulsion layer side, and preferably to the silver halide emulsion layer or its adjacent layer. The addition amount is preferably $10^{-6}$ to $10^{-1}$ mol/mol of silver, and more preferably $10^{-5}$ to $10^{-2}$ mol/mol of silver, although the optimum amount is different depending on silver halide grain diameter, silver halide grain halide composition, the degree of chemical sensitization, or kinds of restrainers to be used.

In the black and white silver halide photographic light sensitive material used in the invention, at least one conductive layer is preferably provided on a support. As a method of forming a conductive layer there is a method of forming it using a water soluble conductive polymer, a hydrophobic polymer and a hardener or a method of forming it using metal oxides. Regarding this method, the method described in Japanese Patent O.P.I. Publication No. 3-265842/1991 can be used.

In a silver halide emulsion applicable to the invention, any silver halide applicable to a common silver halide emulsion can be used, such as silver bromide, silver iodobromide, silver iodochloride, silver chlorobromide, and silver chloride. Among these silver halides, it is preferable to use silver chloride or silver bromochloride having a silver chloride content of not more than 50 mol %.

It is also preferable to use a monodisperse type grain having a variation coefficient of not higher than 15%. Such a variation coefficient is obtained by measuring a grain size through an electronmicrography method and is represented by (Standard deviation of grain sizes)/(Average grain size) x100.

A silver halide emulsion of the invention can be applied with various techniques and additives each well-known in the art.

For example, a silver halide photographic emulsion and a backing layer each applicable to the invention may also contain a variety of a chemical sensitizer, a color toner, a layer hardener, a surfactant, a thickener, a plasticizer, a lubricant, a development inhibitor, a UV absorbent, an anti-irradiation dye, a heavy metal and a matting agent, in various methods. A silver halide photographic emulsion and a backing layer each may further contain a polymer latex.

The above-mentioned additives are further detailed in the above described RD, Vol. 176, 7643 (December, 1978) and, ibid., Vol. 187, 8716 (November, 1979). The pages and columns where the additives are described will collectively be shown below.

| | Additive | RD/7643 | RD/8716 |
|---|---|---|---|
| 1. | Chemical sensitizer | p.23 | p.648, r.col. |
| 2. | Sensitivity increaser | | " |
| 3. | Spectral sensitizer<br>Supersensitizer | pp.23–24 | p.648, r.col.–<br>p.649, r.col. |
| 4. | Whitening agent | p.24 | |
| 5. | Antifoggant | pp.24–25 | p.649, r.col. |
| 6. | Light absorbent &<br>filter dye<br>UV absorbent | pp.25–26 | p.649, r.col.–<br>p.650, l.col. |
| 7. | Antistaining agent | p.25, r.col. | p.650, l–r.col. |
| 8. | Hardener | p.26 | p.651, l.col. |
| 9. | Binder | p.26 | " |
| 10. | Plasticizer & lubricant | p.27 | p.650, r.col. |
| 11. | Coating aid & surfactant | pp.26–27 | " |
| 12. | Antistatic agent | p.27 | " |

In the invention, an emulsion layer or a protective layer may be a single layer or multilayers comprised of two or more layers. In the multilayers, an intermediate layer may be provided between the layers.

A support applicable thereto include, for example those made of a polyester such as cellulose acetate, cellulose nitrate and polyethylene terephthalate, polyolefin such as polyethylene, polystyrene, baryta paper, polyolefin-coated paper, glass and metal. These supports may be subbed, if required.

EXAMPLES

The invention will be detailed in the following examples, but is not limited thereto.

Example 1

Preparation of SPS

In 200 parts by weight of toluene were reacted 100 parts by weight of styrene, 56 g of triisobutylaluminium and 234 g of pentamethylcyclopentadienyltitanium trimethoxide at 96° C. for 8 hours. To the resulting reaction mixture was added a sodium hydroxide methanol solution and the catalyst was decomposed. Thus, the product was obtained and washed three times with methanol. The yield was 34 parts by weight.

Preparation of SPS film

The above obtained SPS was melt-extruded at 330° C. from a T die in a layer form, and brought into contact with a chilling drum and solidified to obtain an unoriented film. The SPS was supplied to the chilling drum at three different speeds. The thus obtained 1054 μm thick unoriented film was heated at 135° C. and oriented by 3.1 times in a machine direction, then at 130° C. by 3.4 times in a transversal direction and heat set at 250° C. Thus, a 100 μm thick biaxial oriented film was obtained as a support having a bending modulus of elasticity of 450 kg/mm$^2$.

Subbing layer coating on the SPS film

The above obtained SPS film surface was subjected to corona discharge treatment at 0.5 kV.A.min./m$^2$. The resulting film was coated with a subbing layer latex solution (containing a solid component concentration of 20%) and dried at 120° C. for 1 minute to have a thickness of 0.5 μm. Silica was deposited by evaporation on the subbing layer and then an adhesion layer composition containing styrene-glycidylacrylate and gelatin was coated on the resulting layer.

(Preparation of silver halide emulsion A)

Silver bromochloride core grains comprised of 70 mol % of silver chloride and silver bromide, which had an average thickness of 0.05 μm and an average diameter of 0.15 μm, were prepared in a double-jet precipitation method. In the process $K_3RuCl_6$ was added in an amount of $8\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.2 mol % of silver iodide and silver bromide), having an average thickness of 0.10 μm and an average diameter of 0.25 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $12\times10^{-5}$ mol/mol of silver of chloroauric acid and $3\times10^{-6}$ mol/mol of silver of inorganic sulfur and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and gelatin were added to the emulsion to obtain silver halide emulsion A.

(Preparation of silver halide emulsion B)

Silver iodobromochloride core grains comprised of 60 mol % of silver chloride, 1.5 mol % of silver iodide and silver bromide, which had an average thickness of 0.05 μm and an average diameter of 0.15 μm, were prepared in a double-jet precipitation method. In the process $K_3Rh(H_2O)Br_5$ was added in an amount of $2\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.2 mol % of silver iodide and silver bromide), having an average thickness of 0.10 μm and an average diameter of 0.42 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $2\times10^{-5}$ mol/mol of silver of chloroauric acid and $3\times10^{-5}$ mol/mol of silver of N,N,N'-trimethyl-N'-heptafluoroselenourea and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and gelatin were added to the emulsion to obtain silver halide emulsion B.

(Preparation of silver halide photographic light-sensitive material for graphic arts for He—Ar laser light)

On the subbing layer of the above support were simultaneously coated the following gelatin subbing layer composition, Prescription 1 in an amount of 0.5 g/m² of gelatin, the following silver halide emulsion 1 composition, Prescription 2 in an amount of 2.9 g/m² of silver and of 0.5 g/m² of gelatin, the following intermediate layer composition, Prescription 3 in an amount of 0.3 g/m² of gelatin, the following silver halide emulsion 2 composition, Prescription 4 in an amount of 0.2 g/m² of silver and of 0.4 g/m² of gelatin, and the following protective layer composition, Prescription 5 in an amount of 0.6 g/m² of gelatin, in that order.

At the same time as the above coating, on the subbing layer of the support opposite the emulsion layer were simultaneously coated the following backing layer composition, Prescription 6 in an amount of 0.6 g/m² of gelatin, the following hydrophobic polymer layer composition, Prescription 7 and the following backing protective layer composition, Prescription 8 in an amount of 0.4 g/m² of gelatin, in that order. Thus, light- sensitive material samples were prepared.

| Prescription 1 (gelatin subbing layer composition) | |
|---|---|
| Gelatin | 0.5 g/m² |
| Solid dispersion particles of Dye AD-11 (Average diameter 0.1 μm) | 25 mg/m² |
| Solid dispersion particles of Dye AD-8 (Average diameter 0.1 μm) | 20 mg/m² |
| Polystyrene sodium sulfonate (Average molecular weight 500,000) | 10 mg/m² |
| S-1 (sodium isoamyl-n-decylsulfosuccinate) | 0.4 mg/m² |
| **Prescription 2 (silver halide emulsion layer 1 composition)** | |
| Silver halide emulsion A | 2.9 g/m² (in terms of silver) |
| Cyclodextrin (hydrophilic polymer) | 0.5 g/m² |
| Sensitizing Dye d-1 | 6 mg/m² |
| Sensitizing Dye d-2 | 3 mg/m² |
| Hydrazine derivative: Exemplified Compound H-7 | 30 mg/m² |
| Nuclear promoting agent: Exemplified Compound Na-3 | 40 mg/m² |
| Compound e | 100 mg/m² |
| Latex polymer f | 1.0 g/m² |
| Hardener g | 5 mg/m² |
| S-1 | 0.7 mg/m² |
| 2-Mercapto-6-hydroxypurine | 10 mg/m² |
| EDTA | 50 mg/m² |
| Colloidal silica (average diameter 0.05 μm) | 10 mg/m² |
| **Prescription 3 (intermediate layer composition)** | |
| Gelatin | 0.3 g/m² |
| S-1 | 2 mg/m² |
| **Prescription 4 (silver halid emulsion layer 2 composition)** | |
| Silver halide emulsion B | 0.2 g//m² (in terms of silver) |
| Sensitizing Dye d-1 | 0.5 mg/m² |
| Redox T-26 | $1.2\times10^{-4}$ mol/AgX |
| S-1 | 1.7 mg/m² |
| **Prescription 5 (emulsion protective layer composition)** | |
| Gelatin | 0.6 g/m² |
| Solid dispersion particles of Dye AD-5 (Average diameter 0.1 μm) | 40 mg/m² |
| S-1 | 12 mg/m² |
| Matting agent (monodispersed silica of an average diameter 3.5 μm) | 25 mg/m² |
| 1,3-Vinylsulfonyl-2-propanol | 40 mg/m² |
| Surfactant h | 1 mg/m² |
| Colloidal silica (Average diameter 0.1 μm) | 20 mg/m² |
| Hardener k2 | 30 mg/m² |
| **Prescription 6 (backing layer compositon)** | |
| Gelatin | 0.6 g/m² |
| S-1 | 5 mg/m² |
| Latex polymer f | 0.3 g/m² |
| Colloidal silica (average diameter 0.05 μm) | 70 mg/m² |
| dye k | 20 mg/m² |
| Polystyrene sodium sulfonate | 20 mg/m² |
| Compound i | 100 mg/m² |
| **Prescription 7 (hydrophobic polymer layer composition)** | |
| Latex (methylmethacrylate:acrylivc acid = 97:3, mol ratio) | 1.0 g/m² |
| Hardnere g | 1 mg/m² |
| **Prescription 8 (protective backing layer composition)** | |
| Gelatin | 0.4 g/m² |
| Matting agent (monodispersed polymethyl methacrylate of an average diameter of 5 μm) | 50 mg/m² |
| Sodium-di-(2-ethylhexyl)sulfosuccinate | 10 mg/m² |
| Surfactant h | 1 mg/m² |
| $H-(OCH_2OCH_2)_{68}-OH$ | 50 mg/m² |
| Hardener: k2 | 20 mg/m² |

-continued

AD-11

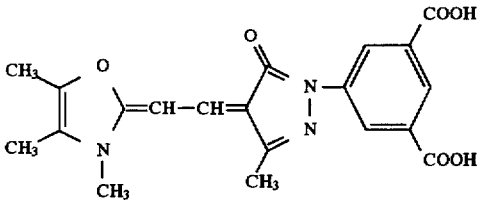

AD-8

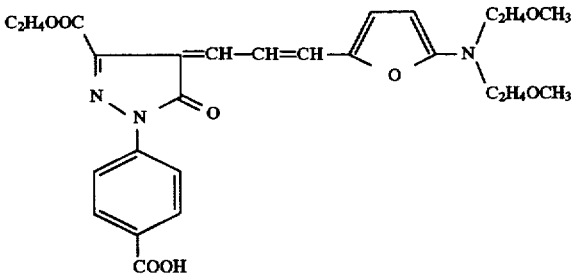

Sensitizing Dye d-1

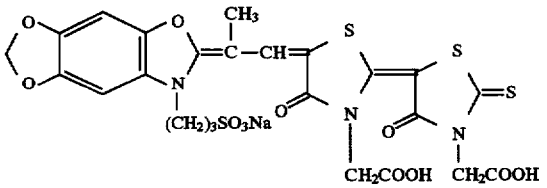

Sensitizing Dye d-2

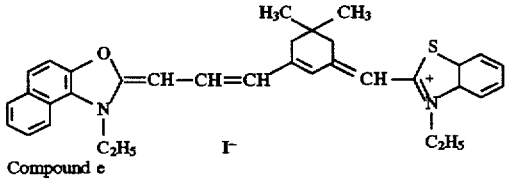

Compound e

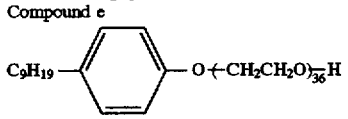

Latex polymer f

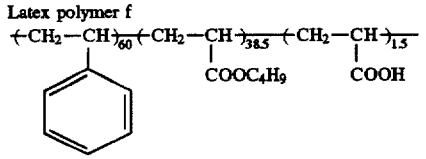

Hardener g

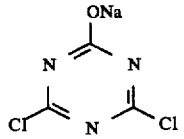

Redox T-26

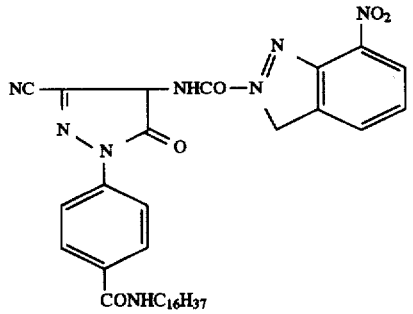

-continued

AD-5

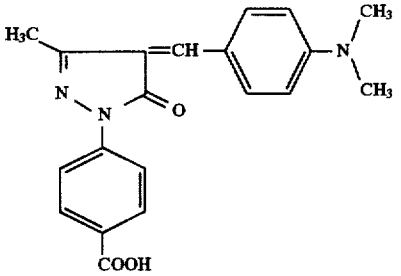

Surfactant h

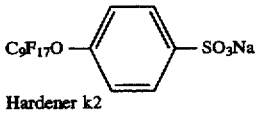

Hardener k2

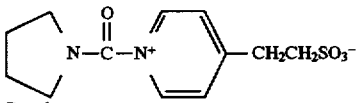

Dye k

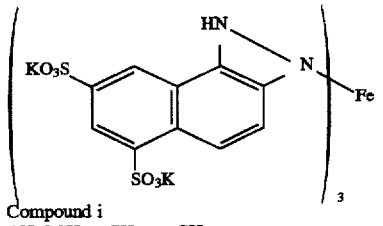

Compound i

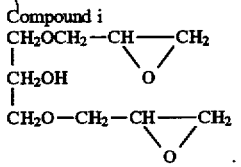

After drying, the surface specific resistance on the backing layer side was $5\times10^{11}$ at 23° C. and 20% RH, and the surface on the emulsion layer side had a pH of 5.6.

(Preparation of processing solutions)

Developer 1 composition (amount per 1 liter of developer to be used)

| | |
|---|---|
| Aqueous 40 wt % diethylene triamine pentaacetic acid solution | 3.63 g |
| Sodium sulfite | 16 g |
| Potassium bromide | 7 g |
| Sodium carbonate | 105 g |
| Sodium bicarbonate | 15 g |
| 8-Mercaptoadenine | 0.06 g |
| Sodium erisorbinate (Sodium iso-ascorbinate) | 25 g |
| Dimeson S (1-phenyl-4-methyl-4-hydroxymethyl-3-pyrazolidone) | 1.5 g |
| Benzotriazole | 0.21 g |
| 1-phenyl-5-mercaptotetrazol | 0.025 g |
| Add water to make 1 liter and adjust pH with sodium hydroxide to be 10.4 | |

Developer 2 composition (amount per 1 liter of developer to be used)

| | |
|---|---|
| Aqueous 40 wt % diethylene triamine pentaacetic acid solution | 3.63 g |
| Sodium sulfite | 42.5 g |
| Potassium sulfite | 12.6 g |

-continued

| | |
|---|---|
| Potassium bromide | 4 g |
| Boric acid | 8 g |
| Potassium carbonate | 55 g |
| Potassium bicarbonate | 15 g |
| 8-Mercaptoadenine | 0.07 g |
| Diethylene glycol | 40 g |
| Hydroquinone | 20 g |
| Dimeson S | 0.85 g |
| Benzotriazole | 0.21 g |
| 1-phenyl-5-mercaptotetrazol | 0.032 g |
| Add water to make 1 liter and adjust pH with potassium hydroxide to be 10.4. | |

1) Stabilizing solution

Washing water

The tap water was used.

2) Rinsing solution composition (amount per 1 liter of rinsing solution to be used)

| | |
|---|---|
| EDTA.2Na | 40 g |
| Potassium hydroxide | 23 g |
| Potassium carbonate | 12 g |
| Potassium sulfite | 110 g |
| *Sanback-P (produced by Sanai Sekiyu Co., Ltd.) | 20 g |
| Add water to make 1 liter. | |

*Containing hexahydro-1,3,5-triazine-1,3,5-triethanol

Fixer

As a fixer, CFL-881 (produced by Konica Corp.) was used.

Processing condition

| (Processing step) | (Temperature) | (Time) |
|---|---|---|
| Developing | 35° C. | 15 seconds |
| Fixing | 35° C. | 12 seconds |
| Stabilizing (washing or rinsing) | room temp. | 10 seconds |
| Drying | 50° C. | 10 seconds |

The above obtained silver halide photographic light sensitive material samples were processed according to the above processing conditions and the following running conditions.

Automatic processor: LD-220Q (produced by Dainihon Screen Co., Ltd.), which was modified so that the rinsing solution was also replenished.

Developer replenishing amount: 150 ml/m$^2$

Fixer replenishing amount: 200 ml/m$^2$

The replenishing amount of the washing water or the rinsing solution, which was used as a stabilizer, is shown in Table 1.

Evaluation test a) Residue occurrence test

Residue occurrence in the washing water or rinsing solution was evaluated as follows:

Half of the above obtained 505×610 mm light sensitive material sample of was exposed to sunlight for 1 second to obtain an exposed sample. Thereafter, 50 exposed samples and 50 unexposed samples were processed per day, alternately, for a total of 100 samples per day. The processing was carried out for 20 consecutive days without disposing of the washing water or rinsing solution, and then occurrence of residue in the washing water or rinsing solution was evaluated.

The evaluation criteria were as follows:

No residue occurrence was evaluated as excellent and as "5". Slight residue occurrence was evaluated as applicable lowest limit and as "3" Residue occurrence, in which the washing water was turbid, was evaluated as poor and as "1".

b) Staining

The last unexposed sample of the above processed samples was cut to obtain ten sheets of 135×35 mm light sensitive material. The thus obtained ten sheets were stacked for evaluation of staining. An excellent level of staining was evaluated as "5", a fair level as "3", which is marginally usable, and a poor level as "1". The results are shown in Table 1.

The results are shown in Table 1.

TABLE 1

| Test No. | Developer No. | Stabilizer Solution: Kind of Solution | Replenishing Amount (liter/m$^2$) | Residue Occurrence | Staining | Remarks |
|---|---|---|---|---|---|---|
| 1 | 1 | Water | 3.0 | 5 | 5 | Comp. |
| 2 | 2 | Water | 3.0 | 4 | 4 | Comp. |
| 3 | 1 | Water | 2.0 | 4.5 | 4 | Inv. |
| 4 | 2 | Water | 2.0 | 2 | 2 | Comp. |
| 5 | 1 | Water | 1.5 | 4 | 4 | Inv. |
| 6 | 2 | Water | 1.5 | 1 | 1.5 | Comp. |
| 7 | 1 | Water | 1.0 | 4 | 3.5 | Inv. |
| 8 | 1 | Water | 0.5 | 3.5 | 3.5 | Inv. |
| 9 | 1 | Rinsing Water | 3.0 | 5 | 5 | Comp. |
| 10 | 2 | Rinsing Water | 3.0 | 5 | 5 | Comp. |
| 11 | 1 | Rinsing Water | 2.0 | 5 | 4.5 | Inv. |
| 12 | 2 | Rinsing Water | 2.0 | 2.5 | 2.5 | Comp. |
| 13 | 1 | Rinsing Water | 1.5 | 4.5 | 4.5 | Inv. |
| 14 | 2 | Rinsing Water | 1.5 | 2 | 2 | Comp. |
| 15 | 1 | Rinsing Water | 1.0 | 4.5 | 4 | Inv. |
| 16 | 1 | Rinsing Water | 0.5 | 4 | 4 | Inv. |
| 17 | 1 | Rinsing Water | 0.25 | 3.5 | 3.5 | Inv. |

Comp.: Comparative
Inv.: Invention

What is claimed is:

1. A method of processing an exposed silver halide photographic light sensitive material comprising a support and provided thereon, a silver halide emulsion layer, using an automatic developing machine, the method comprising the steps of:

developing the exposed material with developer, the developer being replenished with developer replenisher and the developer containing substantially no dihydroxy benzene compound and containing a developing agent represented by the following Formula [1]:

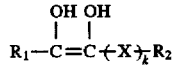

Formula [1]

wherein $R_1$ and $R_2$ independently represent an alkyl group, an amino group, an alkoxy group or an alkylthio group, or $R_1$ and $R_2$ combine with each other to form a ring, k represents 0 or 1, and X represents —CO— or —CS—;

fixing the developed material;

stabilizing the fixed material with a washing water which is replenished with water replenisher in a replenishing amount of 0.5 to 2 liter/m$^2$ or with a rinsing solution containing chelating compounds which is replenished with a rinsing replenisher in a replenishing amount of 0.25 to 2 liter/$m^2$; and drying the stabilized material.

2. The method of claim 1, wherein the developing agent content of the developer is 0.2 to 0.4 mol/liter.

3. The method of claim 1, wherein the developing agent represented by Formula [1] is a compound represented by

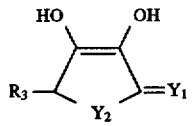

Formula [1-a]

wherein $R_3$ represents a hydrogen atom, an alkyl group, an aryl group, an amino group, an alkoxy group, a sulfo group, a carboxy group, an amido group or a sulfonamido group; $Y_1$ represents O or S; $Y_2$ represents O, S or $NR_4$ in which $R_4$ represents a hydrogen atom, an alkyl group or an aryl group.

4. The method of claim 1, wherein the developer further contains a 3-pyrazolidone derivative or an aminophenol derivative.

5. The method of claim 1, wherein the rinsing solution contains a chelating agent.

6. The method of claim 1, wherein a total processing time is 10 to 60 seconds.

7. The method of claim 1, wherein the silver halide photographic light sensitive material comprises a hydrazine compound represented by the following Formula [H]:

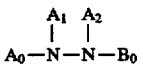

Formula [H]

wherein $A_0$ represents an aliphatic group, an aryl group or a heterocyclic group; $B_0$ represents —$G_0$—$D_0$— in which $G_0$ represents —CO— or —COCO— and $D_0$ represents a hydrogen atom, an amino group or an alkoxy group; $A_1$ and $A_2$ represent both hydrogen atoms, provided that when one of $A_1$ and $A_2$ represents a hydrogen atom, the other represents an acyl group, a sulfonyl group or an oxalyl group.

8. The method of claim 7, wherein the silver halide photographic light sensitive material further comprises a nucleation accelerating agent represented by the following Formula [Na] or [Nb]:

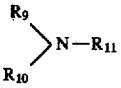

Formula [Na]

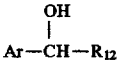

Formula [Nb]

wherein $R_9$, $R_{10}$ and $R_{11}$ independently represent a hydrogen atom, an alkyl group, an alkenyl group, group, an alkinyl group or an aryl group or two of the $R_9$, $R_{10}$ and $R_{11}$ combine with each other to form a ring together, provided that $R_9$, $R_{10}$ and $R_{11}$ are not simultaneously hydrogen atoms; Ar represents an aryl group or a heterocyclic group; $R_{12}$ represents a hydrogen atom, an alkyl group, an alkinyl group or an aryl group or Ar and $R_{12}$ combine through another linkage group to form a ring.

9. The method of claim 1, wherein the silver halide photographic light sensitive material comprises a tetrazolium compound represented by the following Formula [T]:

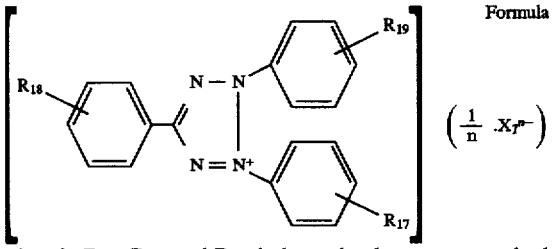

Formula [T]

wherein $R_{17}$, $R_{18}$ and $R_{19}$ independently represent a hydrogen atom or a group having a negative value of a Hammett's sigma value (σP); n represents 1 or 2, and $X_T^{n-}$ represents an anion.

10. The method of claim 1, wherein the step of stabilizing the fixed material comprises stabilizing the fixed material with a washing water which is replenished with a water replenisher in the replenishing amount of 0.5 to 2 liter/$m^2$.

11. The method of claim 1, wherein the step of stabilizing the fixed material comprises stabilizing the fixed material with the rinsing solution containing chelating compounds which is replenished with a rinsing replenisher in the replenishing amount of 0.25 to 2 liter/$m^2$.

* * * * *